United States Patent [19]

Braddyll et al.

[11] 4,130,366

[45] Dec. 19, 1978

[54] HOMOGENIZATION METHOD

[75] Inventors: John R. G. Braddyll, Kirby-in-Furness; Joseph H. Aubrey, Barrow-in-Furness; Ernest A. Shaw, Barrow-in-Furness; Ian Palmer, Barrow-in-Furness, all of England

[73] Assignee: Vickers Shipbuilding Group Limited, Cumbria, England

[21] Appl. No.: 843,029

[22] Filed: Oct. 17, 1977

[30] Foreign Application Priority Data

Jul. 8, 1977 [GB] United Kingdom ..... 28859/77

[51] Int. Cl.[2] ..... B01F 7/00

[52] U.S. Cl. ..... 366/288; 366/297

[58] Field of Search ..... 366/287, 288, 297, 272, 366/314; 241/19, 20

[56] References Cited

U.S. PATENT DOCUMENTS

| | | | |
|---|---|---|---|
| 3,443,796 | 5/1969 | Shearer | 366/287 |
| 3,443,798 | 5/1969 | Overcashier | 366/272 |
| 3,559,956 | 2/1971 | Gray | 366/272 |
| 3,618,864 | 11/1971 | Szego | 241/19 |

*Primary Examiner*—Edward J. McCarthy

*Attorney, Agent, or Firm*—Browdy and Neimark

[57] ABSTRACT

A homogenization method particularly applicable to fuel oil containing water and/or coal dust is described. Ideal homogeneity is achieved by supplying the substances to be homogenized between cooperating surfaces one of which is afforded by the internal circumferential surface of a homogenization chamber and the other of which is afforded by the external circumferential surface of the first of a coaxial stack of discs whose edges are cylindrical or are part-spherical, causing the substances to cross the path of rolling of the discs so as to cause disintegration of a phase or phases insoluble in the liquid or one said liquid between the discs and said circumferential surface in the region of the point of the rolling engagement as the substances pass under gravity down through the homogenization chamber and withdrawing the homogeneous liquid obtained from the other end of the chamber beyond the path of rolling movement of the discs, the discs being unrestrained mechanically against movement towards and away from the internal surface of the chamber throughout their rolling motion and the pressure between them and the chamber surface being produced solely by centrifugal force.

11 Claims, 9 Drawing Figures

HOMOGENIZATION METHOD

This invention relates to the homogenisation of mixtures of substances which are normally considered as immiscible and more particularly, but not exclusively, to the production of flowable homogeneous mixtures of fuel oil and water and/or coal dust.

If oil and water are mixed together and the mixture allowed to stand, it will separate into two distinct layers with the oil usually forming the upper layer or phase. The reason for this phenomenon is that oil and water are generally insoluble. In contrast, a mixture of acetone and water will have only a single phase because these two substances are mutually soluble in any proportion. A corresponding situation exists when a solid is mixed in a liquid. If a solid is coal and the liquid is water, two phases will be present because coal is insoluble in water, but if the solid is salt and the liquid is water, then only a single phase is formed because a reasonable proportion of salt is soluble in water. In the case of a solution, whether of two or more liquids or one or more liquids and one or more solids, diffusion processes uniformly distribute the components so that the composition of any microscopic portion of the solution is identical to that of the whole solution; thus any solution may be described as "homogeneous". In contrast, mixtures of mutually insoluble substances cannot generally be described as homogeneous because of the existence of two or more separate phases. Only if the size of the droplets or particles is very small and they are uniformly distributed in the other phase(s), can the mixture then be said to "approach homogeneity". Nevertheless, however well such mixtures which have previously been produced approach homogeneity, they may not have the characteristic features of homogeneous solutions of retaining constant their composition. In the course of time, the dispersion which is all that is in fact present tends to break down and the components thereof separate out.

However, if a mixture can be produced in which the size of droplets or particles is sufficiently small, it would be reasonable to expect that when the mixture has been made to "approach homogeneity", it will not revert to its original condition because then influences such as electrostatic repulsive charges, surface tension phenomena or Brownian motion would be expected to be instrumental in the substantial retention of the homogeneous state. Such behaviour might be expected if the size of the droplets or particles of the dispersed phase(s) is about 1 micrometer ($10^{-6}$ m). It is to such mixtures, as well as mixtures in which the droplets or solid particles of the dispersed phase(s) are slightly larger so that the viscosity of the mixture produced is such that homogeneity can be maintained for an extended period of time, if not permanently, that the term "homogenise" or "homogeneous" is applied in the present specification. The term "phase" is used herein to denote the existence of either mutually insoluble liquid(s) in liquid(s) or solid(s) in liquid(s).

Apparatus which purports to homogenise mixtures of liquid hydrocarbon fuels and coal dust is described in British patent specifications Nos. 1,363,934, 1,401,072 and 1,401,071. Operators in these specifications rely upon ultrasonic agitation of liquids to achieve the required effect and it is in fact found that with mixtures of coal dust and liquid hydrocarbon fuel it is not possible to reduce the coal to a particle size of less than 100 μm.

Other prior art of interest is to be found in U.S. Pat. No. 3,618,864.

It is an object of this invention to provide a method whereby it is possible to homogenise the aforesaid mixtures of materials. More particularly, it is an object of this invention to provide a mixing operation combined with the application of high compressive and shearing forces whereby the material to be mixed with a main body of liquid is broken down to a sufficiently small droplet or particle size.

Thus, according to the present invention, there is provided a method for the homogenisation as defined herein of mutually insoluble liquids or liquid(s) and solid(s) which comprises supplying the substances to be homogenised between cooperating surfaces one of which is afforded by the internal circumferential surface of a homogenisation chamber and the other of which is afforded by the external circumferential surface of the first of a coaxial stack of discs whose edges are cylindrical or are part spherical, which discs are rotatable about their common axis so as to roll around the internal circumferential surface of the homogenization chamber thereby defining on the said internal surface a path of rolling for the discs, causing the substances to cross the path of rolling of the discs so as to cause disintegration of a phase or phases insoluble in the liquid or one said liquid between the discs and said circumferential surface in the region of the point of rolling engagement as the substances pass under gravity down through the homogenisation chamber and withdrawing the homogeneous liquid obtained from the other end of the chamber beyond the path of rolling movement of the discs, the discs being unrestrained mechanically against movement towards and away from the internal surface of the chamber throughout their rolling motion and the pressure between them and the chamber surface being produced solely by centrifugal force.

The method of this invention benefits particularly from the fact that the apparatus used therein provides several different operations which assist in the homogenisation of the substances being treated therein. Initially, mixing of the substances is achieved as they are supplied to the top of the first disc, either separately or as a pre-mix. The crude mixture then obtained is subjected to the multiple homogenising action of each disc path which consists of four separate mechanisms which are:

1. High compressive force between disc and internal circumferential surface of crushing chamber, hereinafter termed "tyre".
2. High shear forces in the angle of nip between discs and tyre.
3. Highly turbulent agitation in a wave preceding the disc.
4. Emission of spray of homogenised mixture from disc around inside of tyre.

The degree of homogenisation achieved by the combined effect of the four separate mechanisms at any one disc is progressively improved as the substances to be homogenised pass down the tyre to be acted on by the successive discs until eventually the required degree of homogenisation is achieved.

The design of the apparatus employed is such that a reasonable volume of mixture can be treated at any one time whether employed on a batch or a continuous basis. This may be contrasted with the low capacity of apparatus used in milk homogenisation whereby the substances to be homogenised are forced through a narrow metal slit onto a plate. The apparatus employed in the method of this invention can be employed when one of the constituent phases is solid or a very viscous liquid since a sufficiently high compressive or shearing force is exerted to rupture or otherwise fragment the solid or very viscous liquid constituent phase(s).

The method of this invention is generally applicable to combinations of mutually insoluble liquids or liquids and solids. It has been found to be of particular value in connection with fuel oils for supply to marine engines. Because of the heavy nature of the fuel employed, the fuel tanks of ships have to be periodically cleaned out using aqueous cleaning media. At the end of the cleaning operation some water usually remains in the tanks and will normally be supplied to the engine inhomogeneously distributed in the fuel. This will result in unsatisfactory combustion of the fuel and malfunctioning of the engine. This water may be dispersed in the fuel oil if the fuel oil is passed through the apparatus as aforesaid on its way to a ship's engine and such malfunctioning thereof will then be avoided. It is in fact frequently desirable for a small amount of water to be in fuel supplied to internal combustion engines, provided that the water is homogeneously distributed in the fuel. Thus water homogeneously distributed in fuel supply to a diesel engine or a boiler will improve atomisation of the fuel. Moreover, there is achieved a mild combustion improvement by having water vapour present at the time of combustion; this reduces the emission of oxides of nitrogen and solids in exhaust gases.

the method of this invention is also of value in enabling homogeneous mixtures of fuels and coal dust to be produced thereby providing modified fuels having the flow characteristics associated with liquid hydrocarbon fuels yet enabling liquid hydrocarbon fuels to be replaced in part by solid hydrocarbon fuels. The method of the invention allows coal dust to be added to liquid hydrocarbon fuels and reduced to a sufficiently small particle size that a homogeneous dispersion of the coal in the liquid hydrocarbon fuel results. In view of concern as to the life of known stocks of oil, at a time when massive new stocks of coal are being discovered, this provides a ready means of reducing the amount of liquid hydrocarbon fuel consumed while at the same time providing a further market for coal.

Insofar as the production of homogeneous mixtures of oil and coal is concerned, the method of this invention allows the coal to be broken down to a particle size of from 10–15 micrometers. This particle size may be contrasted with the normal particle size of ground coal which has hitherto been subjected to combustion in admixture with liquid hydrocarbon fuel. Such unsatisfactorily combustible mixtures generally contain coal having a particle size of from 100–200 micrometers. Although it is in principal desirable to add as much finely divided coal as possible to liquid hydrocarbon fuel, an upper limit is placed upon the amount of coal to be employed by the fact that when the resulting liquid contains more than about 40% by weight coal, the mixture obtained is no longer pumpable. This is also the case when the oil contains water in addition to coal and in connection with the amount of water which may be safely homogenised in oil to obtain a fuel which is still combustible, the maximum amount of water which can be present in relation to combustible material for the combustible material, which can be oil or oil having coal added thereto, if the combustible substances are to be able to burn is 30% by weight thereof. Generally, the amount of water is about 10% by weight if optimum combustion coupled with effective minimisation of production of solids in exhaust gases is to be achieved.

For a better understanding of the invention, and to show how the same can be carried into effect, reference will now be made, by way of example only, to the accompanying drawings, wherein.

Figure 1:
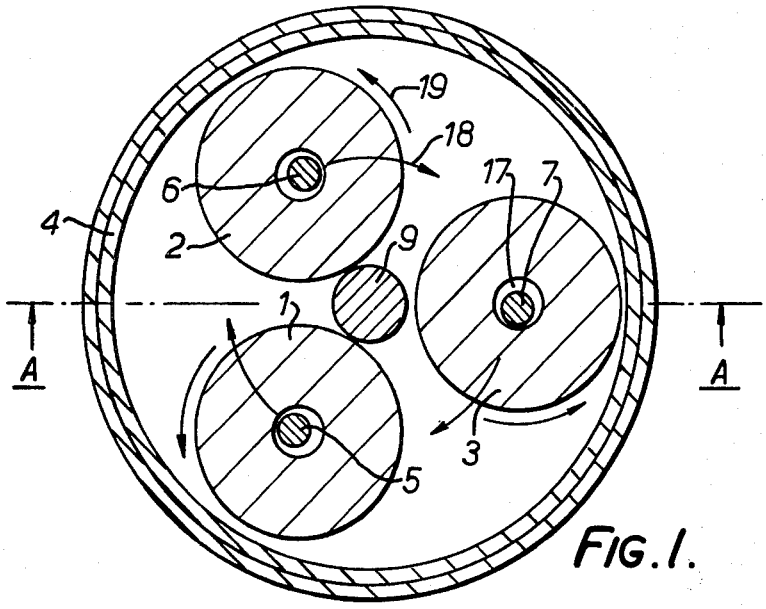
FIG. 1 shows a horizontal section through apparatus for use in the method of this invention.
Figure 2:
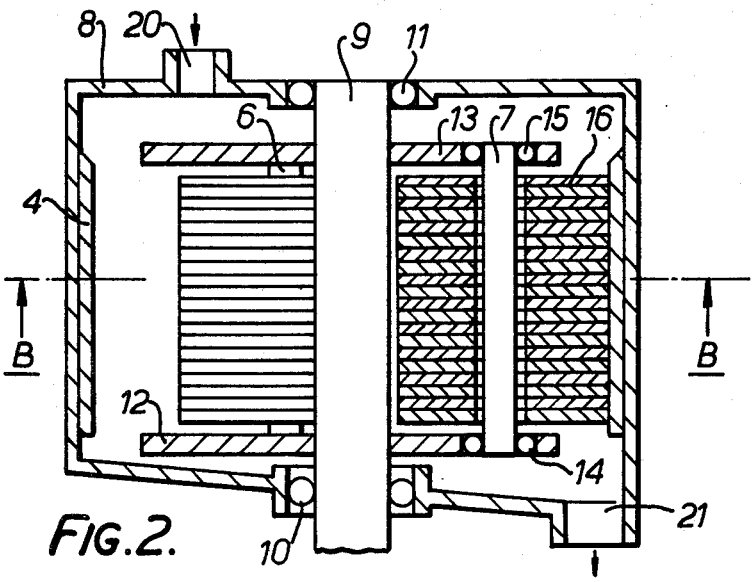
FIG. 2 shows a vertical section through the apparatus of FIG. 1.

Referring to FIGS. 1 and 2 of the drawings, the apparatus shown therein comprises two main parts, namely a casing 8 which is fast with a cylindrical tyre 4 and a rotating assembly supported on a shaft 9. Shaft 9 rotates in bearings 10 and 11 which are housed in the casing 8 and the shaft 9 passes through the casing 8 for connection to a drive member (not shown). Shaft 9 is fast with two circular plates 12 and 13 which serve to locate between them a plurality of stacks of discs, each of which stacks of discs is mounted eccentrically relative to shaft 9. In FIGS. 1 and 2, three stacks are shown each containing twenty discs. However the numbers of stacks and discs in each stack may be varied having regard in this connection to the size of the casing 8, and more particularly the tyre 4. The circular plates 12 and 13 provide housings for bearings 14 and 15 respectively, these bearings supporting drive spindles 7. Spindles 5 and 6 are also supported by bearings (not shown) which are similar to bearings 14 and 15. Each of the discs 3 has a central hole 17 so that the stack of discs may be assembled on the drive spindle passed therethrough, the whole disc stack then obtained being introduced on the drive spindle between circular plates 12 and 13 as shown in FIG. 2. The lowest disc of discs stack 16 is supported from drive spindle 7 so that it can rotate without touching circular plate 12. As shown in FIG. 1, the other two disc stacks are similarly assembled around drive spindles 5 and 6.

When a driving member is operated so that shaft 9 is caused to rotate, the circular plates 12 and 13 which are fast with shaft 9 impart the driving force to drive spindles 5, 6, 7, causing them to rotate about shaft 9 as shown by arrow 18 (FIG. 1). As the speed of rotation increases, the stacks of discs will be thrown radially outwards from shaft 9 by centrifugal force until they contact cylindrical tyre 4. Friction between the discs 3 and the cylindrical tyre 4 will cause the disc stack to roll around the inside of the tyre, rotating as shown by the arrow 19 (FIG. 1) and defining on the inside of the tyre a path of rolling for the discs. When this state is reached, substances to be homogenised can then be introduced into the casing 8 through an inlet pipe 20 via a valve (not shown) onto circular plate 13. As it rotates, the circular plate 13 distributes the substances uniformly around the circumference of the casing whence the mixture flows under the action of gravity down the surface of the tyre 4. As the crude mixture formed on the plate 13 leaves the plate 13 and flows down the surface of the tyre 4, the discs of the disc stacks roll over it exerting a number of actions thereon which together result in the homogenisation of the crude mixture by the time it has been acted on by the lowest disc of each stack. Because the diameter of the central hole 17 in each disc is larger than the diameter of the driving spindle 7, each disc is given considerable freedom to exercise its individual action. When, for example, a relatively large particle or droplet of one phase enters the path of a disc, that disc can ride up, that is move radially inwards towards shaft 9 as it passes over the particle or droplet. Repeated passages of discs over the particle or droplet will rapidly fragment and disperse the fragment into the continuous phase. After leaving the region of the lowest circular plate 12 the homogeneous mixture obtained collects in the bottom of casing 8 and flows out therefrom through an outlet pipe 21.

Figure 4:
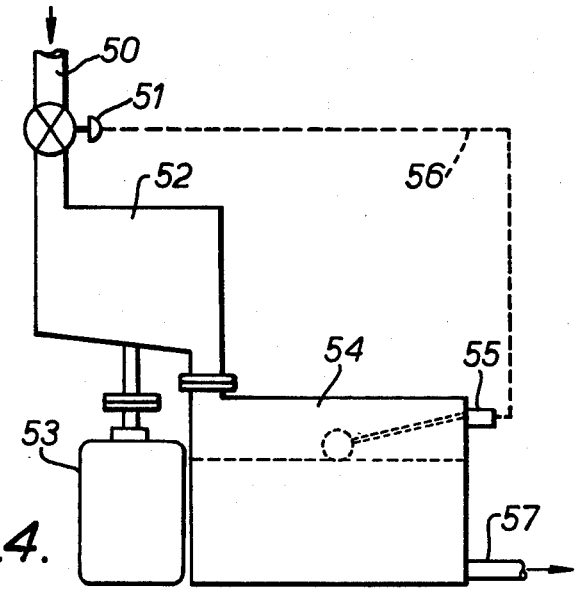
FIG. 4 shows, schematically, an arrangement for producing and supplying to an internal combustion engine a homogenization liquid produced by the method of this invention.

The casing 8 will contain a large quantity of mixture being homogenised at any time. However, it does not run full of the mixture. Referring next to FIG. 4 of the drawings, there is shown an arrangement whereby the correct volume of mixture to be homogenised may be maintained in the casing 8 in accordance with the working capacity of the apparatus employed to carry out the method of the invention and, in particular, demand for the homogeneous mixture, particularly a modified fuel oil which is to be supplied to an internal combustion engine. The arrangement of FIG. 4 comprises an inlet pipe 50 for supplying substances to be homogenised to homogenisation apparatus 52 which can have the form shown in FIGS. 1 and 2. Supply of the substances takes place via a control valve 51. After homogenisation, the homogenised mixture collects in a holding tank 54 and then passes, as required, out through outlet pipe 57. A level controller 55 serves to monitor the level of homogenised mixture in tank 54 and is linked to control valve 51 so that when the homogenised mixture is withdrawn from pipe 57 causing the level in tank 54 to fall, level controller 55 will sense the fall in liquid level and send a signal 56 to operate control valve 51 to initiate flow into the homogenisation apparatus 52. The signal 56 from the level controller 55 to control valve 51 may be of any form but usually will be either of pneumatic or electrical type. The preferred form of control provided by level controller 55 is proportional control. A proportional control causes control valve 51 to open to an extent determined by the liquid level in tank 54 between predetermined high and low levels, that is the lower the liquid level is, the more the valve opens. Automatic low and high level alarms may be fitted as required so that the entire system may be shut off if, owing to malfunctioning, the liquid level passes beyond either the low or the high level in the tank 54.

Figure 3:
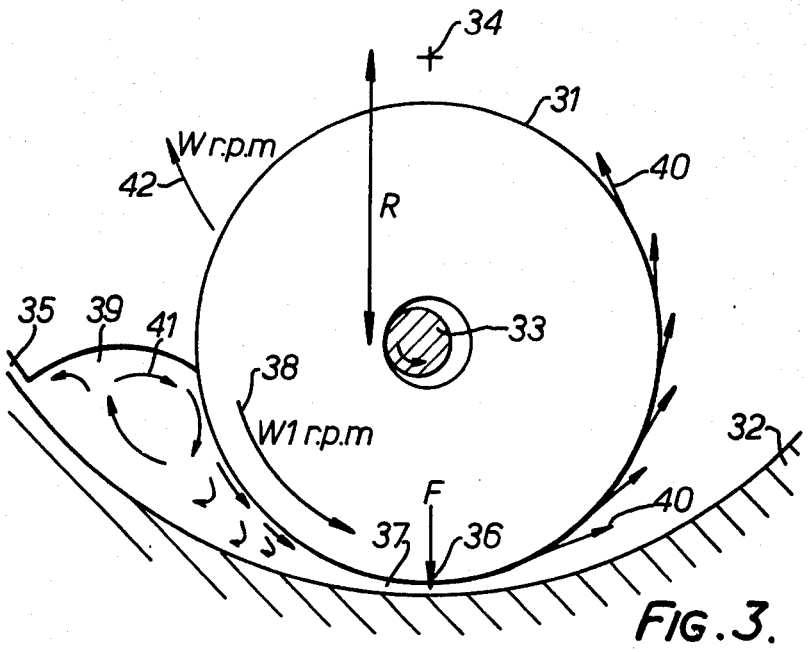
FIG. 3 shows, schematically, the mechanism of homogenization according to the method of this invention.

Referring next to FIG. 3 of the accompanying drawings, there is shown a disc 31 driven by a spindle 33 rolling around a tyre 32. The disc 31 and spindle 33 rotate about axis 34 of the homogenisation apparatus of which they form a part at a speed of W revolutions per minute with the effective radius of the centre of gravity of the disc from the axis 34 being R. The force F exerted on the tyre radially away from the axis 34 is given by $MW^2R$ where M is the mass of the disc. This force F compresses unhomogenised mixture 35 into a thin film 36 between disc 31 and tyre 32 and exerts very high shearing forces on the liquid in the angle of nip 37. Any droplet or particle larger than the thickness of the thin film 36 will be subject to the majority, if not the whole, of compressive force F. The direction of rotation of the disc is shown by arrow 38 and its action in moving around the axis 34 at W r.p.m. causes a "wave" 39 of unhomogenised mixture to build up in front of the disc. As shown by the arrows, the flow pattern inside wave 39 is highly turbulent providing an excellent mixing action as the liquid is continually squeezed out of the angle of nip 37.

The wave 39 exists because the mixture being homogenised is continually squeezed forwards, that is ahead of the disc in the direction shown by an arrow 42 out of the angle of nip 37. The highly turbulent flow pattern existing in wave 39 probably consists of one (or more) large eddies 41 and several smaller eddies between the large eddy or eddies 41 and the angle of nip 37. The radius of eddy 41 is about one fifth that of the radius of disc 31 and consequently, as eddy 41 moves in front of disc 31, it will rotate five times as fast as disc 31, that is at 5 $W_1$ r.p.m. if the rotational speed in the direction of arrow 38 of disc 31 is $W_1$ r.p.m. The radius of disc 31 is $R_1$, the centrifugal acceleration experienced by an object on the disc circumference will be $W_1^2R_1$; this is the acceleration which causes spray 40 to be formed on the opposite side of the disc to wave 41. However, the centrifugal acceleration in eddy 41 may be written as $(5\,W_1)^2\,R_1/5 = 5\,W_1^2R_1$, that is five times as great as the centrifugal acceleration generated by disc 31.

Clearly, if in eddy 41 there exists a multiphase mixture, the denser phase or phases will tend to move towards the circumference of the eddy and, in so doing, will be brought into close proximity with the circumference of disc 31 which will cause it to be dragged into the smaller eddies in the angle of nip 37 and eventually into the thin film 36 under disc 31. If the denser phase is a viscous liquid, the high shearing force present in and between the eddies will break large droplets into smaller and smaller ones until after repeated circuits around the eddies, the droplets become so small as to be an homogeneous part of the continuous phase. If the viscosity of the liquid is such that the shearing forces in and between the eddies are insufficiently large to break the large droplet, then it will be drawn to the angle of nip 37 because a large droplet having relatively large inertia will react only slowly to rapid changes in liquid flow and so be drawn into the angle of nip 37 and become compressed under disc 31. If solids are present in the multiphase liquid, the same mechanisms will apply, that is the solids which are likely to be denser than the liquid will collect at the circumference of the eddies where adjacent particles may rub or hit each other giving rise to possible size reduction by attrition and gradually be drawn into the angle of nip 37 and into thin film 36 under disc 31 to be crushed. Thus the eddies in the highly turbulent wave 39 exert a classifying action which causes both denser phases and large droplets of dispersed phases to be preferentially drawn into the angle of nip 37.

Figure 5:
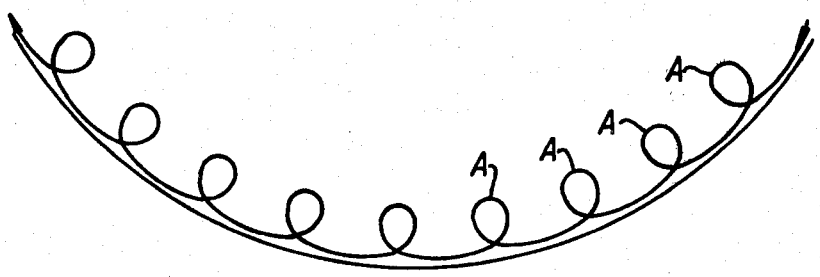
FIG. 5 shows schematically the path executed by material as it moves around the circumference of a tyre of apparatus used in the method of this invention.

The mechanisms of homogenisation in wave 39 have been described for simplicity by considering what happens at one instant of time. In fact, wave 39 is moving forwards around the tyre circumference at W r.p.m. so that the path of any particle or droplet travelling around the circumference of eddy 41 will not be circular but hypocycloidal as shown in FIG. 5. As any second phase particle or droplet moves with constant speed around the hypocycloidal path, it will be subject to the greatest circumferential force when it is changing direction most quickly, that is when it is traversing the tightest radius bends, for example at points A. As A represents the points on the hypocycloid closest to the disc circumference, then any particle or droplet which leaves eddy 41 under the effect of the maximum centrifugal force, that is at a point A on the hypocycloid, will immediately come under the influence of the viscous drag due to the rotating disc 31 and be drawn either into a smaller eddy or into the angle of nip 37 and pass under the disc 31.

Moreover because disc 31 is only one of a stack, unhomogenised mixture forming wave 39 cannot escape the angle of nip 37 by moving up or down the cylindrical tyre 32. The only paths that the liquid can take are forward of the disc into wave 39 or under the disc into thin film 36.

As already mentioned, after the disc has passed any point around the circumference of the tyre 32, the multiphase mixture which had formed thin film 36 will be released from the compressive force F and that portion of it in contact with and adjacent to the disc surface will be flung violently off the disc owing to the disc's high rotational speed to form a spray as shown by the six arrows 40. Thus, the space between the discs will be full of spray homogeneous mixture.

The procedure just described represents the multiple homogenising action of one disc in a single pass. This will be repeated by the product of the number of discs stacks and the number of discs per stack, that is a total of sixty in the apparatus shown in FIGS. 1 and 2 and thus efficient homogenisation will be achieved. Hence, in particular, the four aforesaid homogenising actions, namely (I) high compressive force between disc and tyre; (II) high shear forces in the angle of nip; (III) highly turbulent agitation in the wave preceding the disc; and (IV) spray of homogenised mixture off the disc around inside of apparatus, are obtained. In addition, a certain amount of pre-mixing occurs where the substances to be homogenised rotate on the upper surface of plate 13 (FIG. 2). In FIG. 2, only a single inlet pipe 20 is shown. However, several such pipes may be incorporated to introduce to the homogeniser different substances in the correct proportions prior to homogenisation. As the separate substances fall onto the circular plate 13, a reasonable degree of premixing will occur thereby obviating the need for separate mixing to be carried out. Alternatively, the premixing could be arranged by metering the various substances into a pipe feeding inlet pipe 20. If the multiphase mixture to be homogenised has a high viscosity or contains solid particles or very viscous liquid droplets, a high value of compressive force F will be required. This will be achieved best by using large heavy discs thereby providing a large value for M in the formula $MW^2R$. However geometric considerations will permit only three stacks of discs for example as shown in FIGS. 1 and 2. If, however, the multiphase liquid is of low viscosity, with no solid or highly viscous content, low compressive forces will be adequate so that smaller, lighter discs rotating at a larger radius could be used. In this case it might be feasible to provide more than three disc stacks into the available space in the apparatus employed.

Reverting to the four homogenisation mechanisms which take place to varying effect when carrying out the method of this invention, mechanisms (I) and (II) are most important when mechanically strong highly viscous phases have to be homogenised. Mechanisms (III) and (IV) are particularly important when dealing with low viscosity multiphase liquids and when dispersing the mechanically strong highly viscous phases which have been fragmented by mechanisms (I) and (II). The majority of the energy required for homogenisation is expended on the relatively small volume of multiphase liquid being compressed by force F in thin film 36 (FIG. 3) and subject to the high shear forces in the angle of nip 37.

Figure 6A:
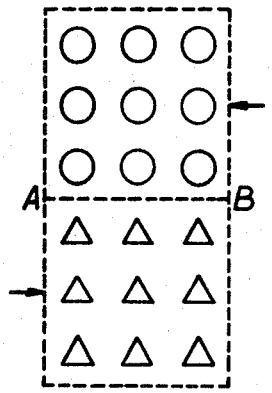
FIGS. 6A, 6B and 6C shows, shcematically, the principle of homogenization of immiscible phases.
Figure 6B:
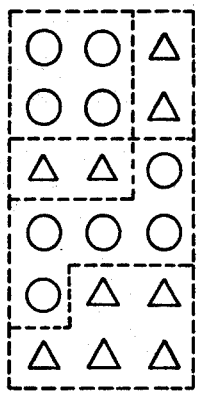
Figure 6C:
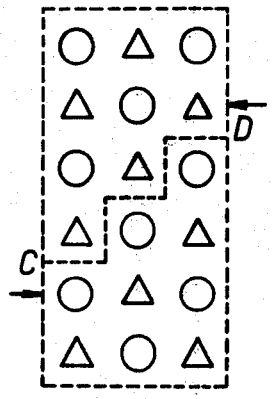

It is a characteristic feature of the homogenisation of a multiphase liquid that as homogenisation progresses, the viscosity increases. This may be illustrated by reference to FIG. 6 of the accompanying drawings which shows the process of homogenisation of a two phase mixture, the phases being represented by circles and triangles respectively. In FIG. 6A, the phases form two distinct layers with possible local mixing at the interface therebetween. After partial homogenisation, the two phases will be coarsely intermingled as shown in FIG. 6B and when completely homogenised, the situation shown in FIG. 6C will prevail. Chemically, the compositions of FIGS. 6A and 6C are identical, but physically they are not; this is particularly apparent when the viscosities of the mixtures are considered. Viscosity is a measure of the rate of movement or liquid mixture when a shear stress is applied. If a shear stress is applied to FIG. 6A as indicated by the arrows, the two phases will tend to move bodily with the relative motion occurring along the dotted line A-B, that is the phase interface. However, if the same shear is applied to FIG. 6C, where there is no clearly defined interface, relative motion will now occur along the stepped dotted line C-D. Clearly the dotted line in FIG. 6C is longer than that in FIG. 6C indicating that the viscosity of the homogeneous mixture is higher than in the unhomogenised state. However, once the shear stress applied to the homogeneous mixture has caused the liquid to start to move, the viscosity may then apparently change, because multiphase homogeneous mixtures display non-newtonian flow characteristics. For example, if a multiphase mixture of oil and water is homogenised, the high viscosity apparent before the mixture has begun to flow will suddenly decrease as the mixture commences to flow, that is the mixture is thixotropic thereby guaranteeing that conditions will exist wherein the mixture produced will be pumpable. This is a matter of considerable concern when modified fuel compositions are being produced for supplying to internal combustion engines, particularly marine engines.

Figure 7:
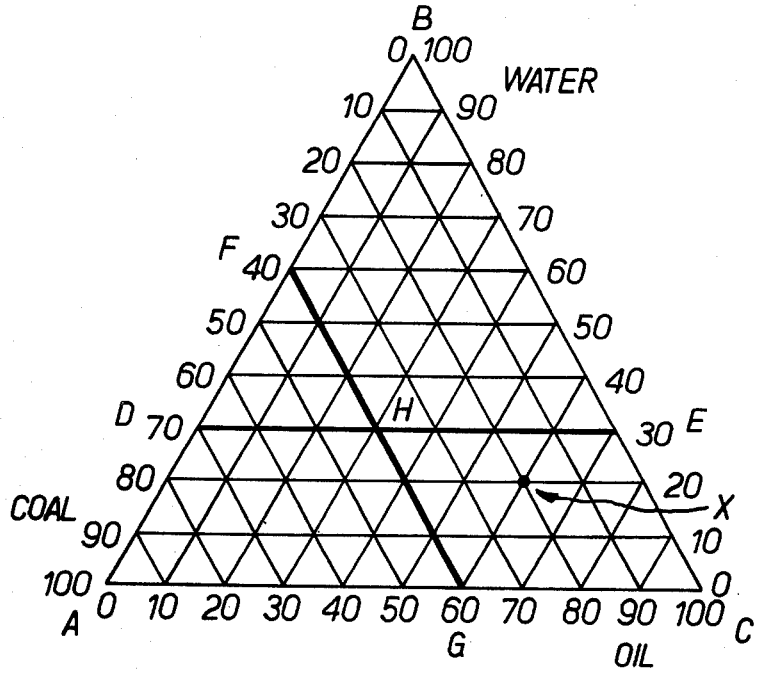
FIG. 7 is a triangular diagram showing the range of compositions of coal — oil — water mixtures which are combustible and pumpable.

As will be appreciated from the foregoing, however it is not sufficient merely that the composition be pumpable. Whilst pumpability is a particular problem insofar as the incorporation of coal dust in oil is concerned, the amount of water which may be present is limited by combustibility requirements. Reference is finally made to FIG. 7 of the accompanying drawings which shows a triangular diagram of a coal-oil-water mixture. In the Figure, point A represents 100% by weight coal with no oil or water present, point B represents 100% by weight water and point C represents 100% by weight oil. The line AC represents coal-oil mixtures with no water present, for example point G is 60% oil and 40% coal. Line DE represents varying coal-oil mixtures in the presence of 30% by weight water. Point H represents a three phase mixture with 40% by weight coal, 30% by weight water and 30% by weight oil.

Considering first the mixtures of coal and oil, if coal is homogenised into oil, the viscosity of the resulting liquid increases until above 40% by weight coal, that is point G, the mixture becomes no longer pumpable. This is also the case if the liquid is not pure oil, but oil and water. Consequently, if the fuel is to be pumped, compositions with more than about 40% by weight coal, that is area AFG must be disregarded. This leaves trapezium GFBC where the composition is pumpable. However, since water is non-combustible and mixtures containing more than about 30% water, that is area DBE, cannot sustain combustion, only compositions lying in trapeziums ADEC are combustible. As trapezium GFBC and ADEC only partially overlap, the only combustible and pumpable compositions lie in parallelogram GHEC in which point X is a typical composition being 60% oil, 20% water and 20% coal.

We claim:

1. A method for the homogenization as defined herein of mutually insoluble liquids or liquid(s) and solid(s) which comprises supplying the substances to be homogenized between cooperating surfaces, one of which surfaces is afforded by the internal circumferential surface of a homogenization chamber and the other of which surfaces is afforded by the external circumferential surface of the first of a coaxial stack of discs whose edges are cylindrical or part spherical, which discs are rotatable about their common axis so as to roll around the internal circumferential surface of the homogenization chamber thereby defining on the said internal surface a path of rolling for the discs;

causing the substances to pass the path of rolling of the discs so as to cause disintegration of a phase or phases insoluble in the liquid or one said liquid between the discs and said circumferential surface in the region of the point of rolling engagement as the substances pass under gravity down through the homogenization chamber; and withdrawing the homogeneous liquid obtained from the other end of the chamber beyond the path of rolling of the discs, the discs being unrestrained mechanically against movement towards and away from the internal surface of the chamber throughout their rolling motion and the pressure between them and the chamber surface being produced solely by centrifugal force.

2. A method as claimed in claim 1, wherein said liquids are fuel oil and water.

3. A method as claimed in claim 2, wherein the homogeneous mixture produced is fed directly to a marine engine.

4. A method as claimed in claim 2, wherein the amount of water is such that the homogeneous liquid produced contains not more than 30% by weight water.

5. A method as claimed in claim 4, wherein the amount of water is such that the homogeneous liquid produced contains not more than 10% by weight water.

6. A method as claimed in claim 1, wherein said liquid is a liquid hydrocarbon fuel and said solid is coal dust.

7. A method as claimed in claim 6, wherein the coal dust is employed in a total amount of up to 40% by weight of the mixture of liquid hydrocarbon fuel and coal dust produced.

8. A method as claimed in claim 1, wherein a homogeneous mixture of fuel oil, water and coal dust is produced.

9. A method as claimed in claim 8, wherein the proportions of fuel oil, water and coal dust are such as to produce a homogeneous mixture whose composition is such that the homogeneous mixture is both pumpable and combustible.

10. A method as claimed in claim 1, wherein the homogenisation chamber comprises a plurality of stacks of said discs mounted between opposed circular plates which are centrally mounted for rotary motion and hence rotary motion of the stacks about an axis passing through the centres of said plates.

11. A method as claimed in claim 1, further comprising:

premixing the substances to be homogenized by fedding the substances onto an upper surface of a circular plate which supports the stack of discs.

* * * * *